United States Patent [19]

Waite et al.

[11] 4,003,389

[45] Jan. 18, 1977

[54] HAIR CURLING APPARATUS

[76] Inventors: Eric L. Waite, 14808 Clark St., Van Nuys, Calif. 91411; Mary I. Waite, 14101 Ventura Blvd., Sherman Oaks, Calif. 91403

[22] Filed: Dec. 18, 1975

[21] Appl. No.: 641,890

Related U.S. Application Data

[63] Continuation-in-part of Ser. No. 405,886, Oct. 12, 1973, Pat. No. 3,939,852.

[52] U.S. Cl. ..... 132/40

[51] Int. Cl.[2] ..... A45P 2/00

[58] Field of Search ..... 132/39, 33, 40, 42, 132/9

[56] References Cited

UNITED STATES PATENTS

| | | | |
|---|---|---|---|
| 3,064,659 | 11/1962 | Solomon | 132/40 |
| 3,209,766 | 10/1965 | Dannat | 132/40 |
| 3,616,804 | 11/1971 | Simoneaux | 132/40 |
| 3,939,852 | 2/1976 | Waite | 132/39 |

*Primary Examiner*—G.E. McNeill

[57] ABSTRACT

An apparatus for hair curling. A substantially cylindrical base is integral with and depends into a plurality of uniformly disposed extension members, each of the extension members being tapered along the longitudinal axis of the cylinder. The diameter of the terminus of the extension members is less than the diameter of the cylindrical base. Each extension member is in uniform spaced relation to adjacent extension members about the circumference of the body of the hair curling apparatus. Each extension member is separated from an adjacent extension member by an open channel which terminates in the vicinity of the cylindrical base. Strengthening ribs are uniformly aligned along the interior surface of each extension member, the strengthening ribs being disposed from the terminus of the extension members along substantially the full length of the extension members and terminating in the vicinity of the cylindrical base.

9 Claims, 6 Drawing Figures

HAIR CURLING APPARATUS

The present invention is a continuation-in-part of copending patent application Ser. No. 405,886, filed Oct. 12, 1973, now U.S. Pat. No. 3,939,852.

BACKGROUND OF THE INVENTION

1. Field of the Invention

The present invention generally relates to hair curling devices and more particularly to those devices which produce curls in the hair of the user and which can be removed subsequent to the wrapping of the hair but prior to the formation of the curl. 2. Prior Art The prior art discloses a number of devices which are used as hair styling apparatus or curlers. One of the devices disclosed by the prior art seeks to produce spiral or cascade style curls wherein the hair spirals or curls in a diminishing diameter. This device provides a roller having a slot extending axially through a wall thereof with the slot opening at one end of the roller. The slot extends for substantially the full length of the roller, terminating short of the opposite roller end. The slotted roller is provided with a set of similarly slotted rollers of graduated diameters so that the roller can be arranged concentrically with the rolled hair lying in annular spaces intermediate the different diameter of rollers. The difficulty and inadequacies inherent in this structure are obvious. Because a plurality of rollers are needed, use thereof is cumbersome as well as substantially increasing the expense thereof to the user. In addition, the roller remains in place during the drying process resulting in substantial discomfort to the user.

Another hair curler disclosed by the prior art is primarily utilized for the formation of ringlets. This device employs a totally cylindrical body which is provided with diametrically opposed slots which extend the entire length thereof along the outside surface. These slots are connected for approximately half their length by a diametral slot for the insertion of a hairpin preliminary to removal of the curler. A second and narrower diametral slot extends perpendicular to the first diametral slot and has a widely tapering mouth for catching the hair in order to start the curl. In the use of this device for the formation of curls, the hair is wrapped about the outer circumference of the cylindrical body with the hairpin being disposed through the slot which extends longitudinally along the outer circumference of the body. One arm of the pin is disposed in the slot beneath the curled hair, the gripping arm of the pin being disposed along the top of the curled hair. The inadequicies inherent to this structure are derived from the rigid constructions which would preclude removal of the curler without disrupting the placement of the hair which has been disposed about the cylindrical body. Since it is absolutely necessary that the radially directed force imposed upon the curled hair from the interior thereof be variable to permit easy removal thereof, the rigid construction would preclude satisfaction of this objective.

The present invention substantially resolves the inadequacies inherent in the devices disclosed by the prior art. A substantially cylindrical base depends into a plurality of uniformly projecting extension members. The diameter of the extension members at the terminus thereof is smaller than the cylindrical base to provide for a tapered construction along the longitudinal axis of the curler. Each extension member is separated from adjacent members by a uniform interval which terminates in the vicnity of the cylindrical base. Strengthening ribs lie along the interior surface of each of the extension members, the strengthening ribs terminating substantially adjacent the end of the cylindrical base. By providing a flexible surface of the extension members with sufficient strength, the radially directed force emanating from the extension members will support and form a uniform cylindrical curl while simultaneously providing the flexibility necessary to remove the curler from the wrapped curl after a hairpin or bobby pin is inserted in place. Use of the present invention requires only a single unit to form a full set of curls. In addition, the drying time of curled hair is substantially reduced since the present invention curling apparatus is removed prior to drying thereby eliminating a restriction to the flow of air.

SUMMARY OF THE INVENTION

The present invention generally comprises a hair curling apparatus which is removeable from a formed curl after the hair has been wrapped but prior to the drying of the curl. A substantially cylindrical base member depends longitudinally into a plurality of uniformly disposed extension members. The diameter of the cylindrical base can be varied to determine the size of the curl to be formed. The extension members are uniformly disposed about the axis of the curling apparatus, the diameter of the terminus of the extension members being smaller than the diameter at the cylindrical base. The tapering achieved by the reduction in diameter provides in part for the flexibility needed to achieve the objectives of the present invention. Each extension member is separated from an adjacent one by an opening which terminates in the vicinity of the cylindrical base. The angular arc formed by each extension member is contingent upon the number of extension members which are in turn determined by the ultimate diameter of the curl sought to be formed.

In order to fabricate a curler which can be effectively removed after the disposition of the hair but prior to the drying of same, the present invention incorporates a structure which will exert a sufficient outwardly directed, radial force but which will also exhibit sufficient flexibility to permit the extension members to be urged radially inwardly at the time the hair of the user is being wrapped about the apparatus. To structurally implement this objective, strengthening ribs are disposed along the inner surface of the extension members. The strengthening ribs run from the terminus of the extension members to a point in the substantial vicinity of the terminus of the cylindrical base. In operation, after the hair of the user is wrapped about the outer surface of the extension members, a hairpin or bobby pin is utilized whereby one arm thereof is disposed along the inner surface of an extension member, the clamping arm being disposed along the top surface of the wrapped hair.

It is therefore an object of the present invention to provide an improved hair curling apparatus.

It is another object of the present invention to provide an improved hair curling apparatus that can be removed subsequent to the formation of the curl but prior to the drying of same.

It is yet another object of the present invention to provide an apparatus which is adaptable to form curls of varying diameter.

It is still yet another object of the present invention to provide an improved hair curling apparatus which is simple and inexpensive to fabricate.

The novel features which are believed to be characteristic of the invention, both as to its organization and method of operation, together with further objectives and advantages thereof will be better understood from the following description considered in connection with the accompanying drawing in which a presently preferred embodiment of the invention is illustrated by way of example. It is to be expressly understood, however, that the drawing is for the purpose of illustration and description only, and is not intended as a definition of the limits of the invention.

DESCRIPTION OF THE PRESENTLY PREFERRED EMBODIMENT

Figure 1:
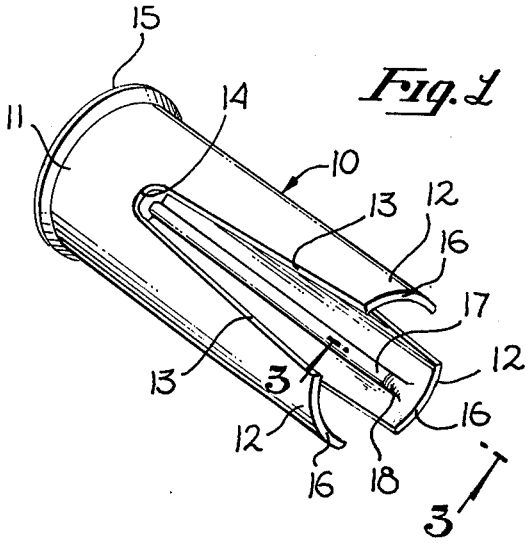
FIG. 1 is a front perspective view of a hair curling apparatus in accordance with the present invention.

A better understanding of the present invention hair curling apparatus can be gained by reference to FIG. 1 wherein a form of the present invention apparatus is shown designated by the reference numeral 10. The hair curling apparatus 10 shown in FIG. 1 comprises a cylindrical base 11 having a predetermined diameter which is based upon the size of the curl to be formed. Longitudinally depending from cylindrical base 11 are a plurality of extension members 12, all extension members 12 being uniformly disposed about the longitudinal axis of hair curler 10. In the form of the present invention hair curling apparatus 10 shown in FIG. 1, three extension members 12 are utilized. Although the number of extension members is a matter of choice, the structure of extension member 12 must provide sufficient surface area to produce a uniform curl, the arc of each extension member 12 must not be so great as to inhibit the radial flexibility of same. Each extension member 12 is uniformly separated from adjacent extension members 12 by an opening which is defined by the lateral edges 13 of each extension member 12. The apex 14 defined by converging pairs of lateral edges 13 is in the vicinity of cylindrical base 11. To provide the needed flexibility, the distance between cylindrical base 11 and apex 14 is generally defined as being less than one-quarter of the full length of hair curling apparatus 10.

As stated previously, an objective of the present invention is to provide a hair curling apparatus that can be removed from the curled hair of the user subsequent to the formation of the curl but prior to drying. This will permit use of only a single unit to form all curls. In addition, elimination of the curling structure will permit the drying air to flow without restriction and thus reduce drying time. The present invention hair curling apparatus 10 is used with conventional hairpins or bobby pins which are well known to those having skill in the art. The particular forms of the pins used would be sufficient to extend the full length of hair curling apparatus 10. The terminus of cylindrical member 11 comprises an outwardly depending flange 15. Flange 15 is integral with cylindrical base 11, the interface being formed by a smooth radial projection of cylindrical base 11. By providing the smooth transistion between cylindrical base 11 and flange 15, the clamping arm of the hairpin will not become retarded by the flange 15 but will move smoothly over the radial transistion so that it can extend beyond flange 15.

Figure 2:
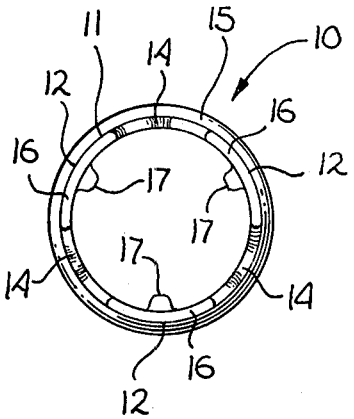
FIG. 2 is a front plan view of the hair curling apparatus shown in FIG. 1 illustrating the interior surface of the hair curling apparatus.

The structure of the present invention which permits it to meet the objectives stated hereinabove can be best seen by reference to FIG. 2. As stated previously, cylindrical base 11 depends into a plurality of extension members 12. In order to provide a hair curling apparatus which can be removed prior to drying of the wrapped hair, extension members 12 are tapered from the point where they depend from cylindrical base 11 to the termni 16 thereof. The diameter of extension members 12 at termni 16 is smaller than the diameter of cylindrical base 11. The uniform tapering of extension members 12 facilitate the removal of hair curling apparatus 10 after the formation of the curl.

Figure 3:
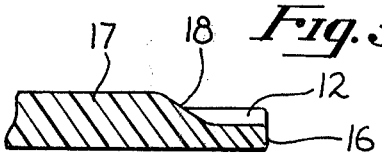
FIG. 3 illustrates a side elevation, cross-sectional view of the extension members shown in FIG. 1 taken through line 3—3 of FIG. 1.

As stated previously, the present invention hair curling apparatus 12 requires sufficient strength to exert an outwardly directed radial force during the curling procedure. Since it is necessary to provide extension members 12 with a sufficiently large surface to insure a uniform curl, and since it is also necessary to provide openings intermediate extension members 12 which are large enough to easily receive hairpins, strengthening ribs 17 are provided along the interior surfaces of extension members 12. Strengthening ribs 17 commence substantially adjacent termni 16 of extension member 12 and are uniformly disposed along the full longitudinal length of extension members 12 terminating in the vicinity of cylindrical base 11. By extending strengthening ribs 17 beyond apex 14, the structural support provided extension members 12 is enhanced. The end surface 18 of strengthening ribs 17 can be best seen by the cross-sectional view shown in FIG. 3. By providing a smooth transistion between the innermost surface of strengthening ribs 17 and extension member 12, any hair which may become entangled within the inner cavity formed by extension members 12 will easily move over the surface of strengthening ribs 17 without becoming further entangled which could produce discomfort to the user.

Figure 4:
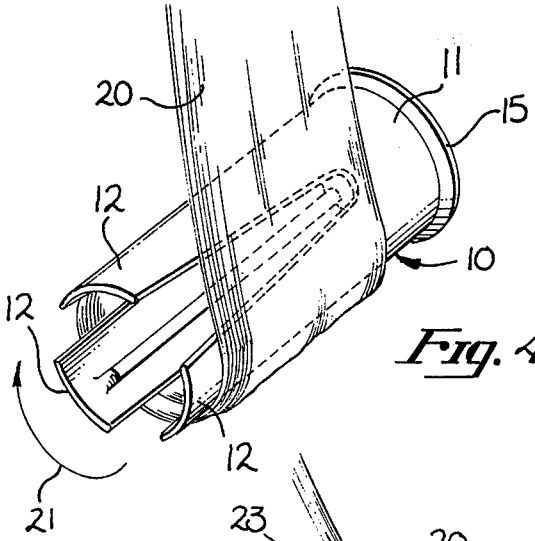
FIG. 4 illustrates the initial curling procedure using the present invention hair curling apparatus.
Figure 5:
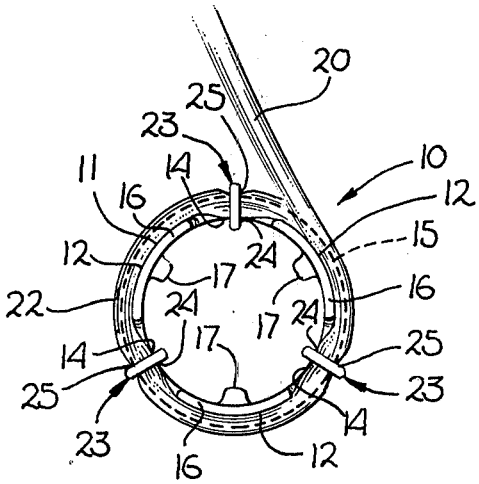
FIG. 5 illustrates the convolutely wound hair about the present invention hair curling apparatus including the placement of hair pins.
Figure 6:
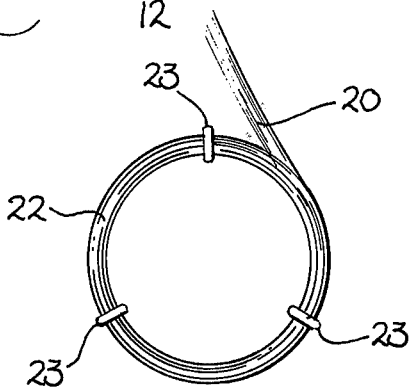
FIG. 6 illustrates the curled hair with the hair in still in place.

The use of the present invention curling apparatus 10 can be best seen by reference to FIGS. 4, 5 and 6 wherein the method of use thereof is shown. In FIG. 4, the user's hair 20 is shown being wrapped about the outer surface of extension members 12. Hair Curler 10 is rotated in the manner shown by directional arrow 21. By convolutely winding hair 20 about the outer surfaces of extension members 12, extension members 12 are radially compressed in the manner shown in FIG. 5. As the user winds hair 20 about extension members 12, the convolute windings 22 comprising the curl will exert a radially inward force which is opposed by the forces incident to strengthening ribs 17. As can be seen in FIG. 4, the diameter of extension ribs 12 in the vicinity of termni 16 is substantially smaller than that which was exhibited in the quiescent state (FIG. 2).

After hair 20 has been convolutely wound about extension members 12 to form curl 22, one or more hairpins 23 are inserted in place as shown in FIG. 5. Hairpins 23 are disposed about curl 22 intermediate lateral edges 13 (FIG. 1) of extension members 12. As stated previously, a conventional hairpin 23 has a generally flat arm 24 which in this case is disposed along the bottom surface of curl 22 adjacent lateral edges 13. The upper clamping arm 25 is disposed along the outer surface of curl 22 and is extended the length of hair curler 10 until clamping arm 25 engages flange 15. Since flange 15 provides a smooth transistion from cylindrical base 11, clamping arm 25 will not be stopped or otherwise hindered by flange 15.

As stated previously, an objective of the present invention was to provide a hair curling apparatus which could be removed subsequent to the formation of curl 22 but prior to drying. During the curling procedure described in connection with FIG. 4 and FIG. 5, it was seen that extension members 12 were compressed. Since extension members 12 are tapered with respect to cylindrical base 11, an element of force produced by strengthening ribs 17 will aid in the removal of hair curler 10. Once hairpins 23 are in place, the user can exert a minimum of longitudinal force on cylindrical base 11 and flange 15 to cause hair curler 10 to be removed from the curl 22 which was formed. As stated, since extension arms 12 are tapered, the friction exerted between the outer surface of extension members 12 and the interior of curl 22 is minimal. As can be seen in FIG. 6, curl 22 is formed with a diameter which is essentially based on a selected diameter for the form of the present invention hair curler 10. After curler 10 has been removed, hairpins 23 will securely hold curl 22 in place, curl 22 adopting the profile and diameter of hair curler 10.

It can therefore be seen that the present invention hair curler 10 has provided an improved apparatus for hair curling procedures. The present invention hair curler is a single unit which can be employed by the user for all hair curling procedures. Once a curl has been formed, hair curler 10 can be removed thereby making it available to make the next curl. In addition, since the user does not have to keep the curling structures within the hair during the drying process, the present invention provides a vastly simpler structure for such operation. The simplicity and costs of fabricating the present invention hair curler 10 can be maintained at a minimum since the structure can be fabricated from such conventional methods as injection molding of conventional thermosetting plastics.

We claim:

1. A hair curling apparatus comprising:

a. a cylindrical base;

b. a plurality of uniformly disposed extension members longitudinally depending from said cylindrical base and defining a substantially cylindrical cavity, each of said extension members being defined by a pair of lateral edges and a terminus in axial opposition to said cylindrical base, the lateral edges of adjacent pairs of extension members converging to an apex which is in the vicinity of said cylindrical base; and c. a circular flange integral with said cylindrical base, the interface intermediate said circular flange and said cylindrical base being a continuous curved surface.

2. A hair curling apparatus as defined in claim 1 wherein the diameter formed by said extension members at the terminus thereof is smaller than the diameter of said cylindrical base.

3. A hair curling apparatus as defined in claim 1 wherein the distance between said apex and said cylindrical base is no more than 25% of the longitudinal length of said hair curling apparatus.

4. A hair curling apparatus as defined in claim 1 including strengthening ribs disposed along the interior surface of said extension members, said strengthening ribs uniformly depending inwardly from said extension members from a point substantially adjacent said termni to said cylindrical base.

5. A hair curling apparatus as defined in claim 4 wherein the interface between the terminus of said extension members and said strengthening ribs is a smooth, continuous surface.

6. A hair curling apparatus comprising:

a. a cylindrical base;

b. a plurality of uniformly disposed, arcuate extension members longitudinally depending from said cylindrical base, each of said extension members being defined by a pair of lateral edges and a terminus in axial opposition to said cylindrical base, the lateral edges of adjacent pairs of extension members converging to an apex which is in the vicinity of said cylindrical base, said extension members being tapered from sais cylindrical base to the termni thereof, the diameter formed by the termni of said extension members being smaller than the diameter of said cylindrical base; and c. a circular rim depending outwardly from said cylindrical base, said rim defining an outwardly directed increasing diameter.

7. A hair curling apparatus as defined in claim 6 wherein the distance between said apex and said cylindrical base is not more than 25% of the longitudinal length of said hair curling apparatus.

8. A hair curling apparatus as defined in claim 6 including strengthening ribs disposed along the interior surface of said extension members, said strengthening ribs uniformly depending into the cavity formed by said extension members, said strengthening ribs being integral with said extension members from a point substantially adjacent said termni to said cylindrical base.

9. A hair curling apparatus as defined in claim 8 wherein the interface between the termni of said extension members and said strengthening ribs is a smooth, continuous surface.

* * * * *